US006135437A

United States Patent [19]

Maass et al.

[11] Patent Number: 6,135,437

[45] Date of Patent: Oct. 24, 2000

[54] DEVICE AND METHOD FOR TRANSPORTING SHEETS SINGLY SEPARATED FROM A SHEET PILE

[75] Inventors: Jürgen Maass, Wiesloch; Bernhard Wagensommer, Gaiberg; Michael Krüger, Edingen-Neckarhausen, all of Germany; Jörg Bauer, Tokyo, Japan

[73] Assignee: Heidelberger Druckmaschinen AG, Heidelberg, Germany

[21] Appl. No.: 08/996,370

[22] Filed: Dec. 22, 1997

[30] Foreign Application Priority Data

Dec. 20, 1996 [DE] Germany ..... 196 53 343

[51] Int. Cl.[7] ..... B65H 5/22

[52] U.S. Cl. ..... 271/5; 271/11; 271/105; 271/107; 271/267

[58] Field of Search ..... 271/11, 12, 107, 271/105, 5, 6, 267; 198/619

[56] References Cited

U.S. PATENT DOCUMENTS

| | | | |
|---|---|---|---|
| 3,466,028 | 9/1969 | Bays | 271/11 |
| 4,081,723 | 3/1978 | Vetter et al. . | |
| 4,151,447 | 4/1979 | von der Heide et al. . | |
| 4,565,478 | 1/1986 | Ericsson | 271/12 X |
| 4,624,617 | 11/1986 | Belna | 198/619 X |
| 4,651,984 | 3/1987 | Emrich . | |
| 4,749,921 | 6/1988 | Chitayat . | |
| 5,086,729 | 2/1992 | Katagiri | 198/619 X |
| 5,595,381 | 1/1997 | Schickedanz | 271/12 |
| 5,793,128 | 8/1998 | Nanba et al. . | |

FOREIGN PATENT DOCUMENTS

| | | |
|---|---|---|
| 114373 | 8/1975 | German Dem. Rep. . |
| 454 704 | 12/1927 | Germany . |
| 923 132 | 12/1954 | Germany . |
| 1177652 | 10/1966 | Germany . |
| 2336387 | 9/1976 | Germany . |
| 3606178C1 | 7/1987 | Germany . |
| 195 11 296 A1 | 10/1996 | Germany . |
| 19511296A1 | 10/1996 | Germany . |

OTHER PUBLICATIONS

Japanese Patent Abstract No. 63–101241 (Sasaki), dated May 6, 1988.

*Primary Examiner*—David H. Bollinger
*Attorney, Agent, or Firm*—Herbert L. Lerner; Laurence A. Greenberg; Werner H. Stemer

[57] ABSTRACT

A device for transporting to a printing press, sheets singly separated from a sheet pile, includes an electromagnetic linear drive mechanism; and a method of operation of the device.

19 Claims, 4 Drawing Sheets

DEVICE AND METHOD FOR TRANSPORTING SHEETS SINGLY SEPARATED FROM A SHEET PILE

BACKGROUND OF THE INVENTION

Field of the Invention

The invention relates to a device and method for transporting to a printing press, sheets which have been singly separated from a sheet pile.

It has long been known to separate sheets from a sheet pile by lifting and transporting them in a direction to a sheet-processing machine, such as a printing press, by suitable lifting and/or feeding equipment, such as suction devices. The lifting and transport motion is controlled in incremental fashion by cam drives.

German Patent 11 77 652 shows a device for transporting sheets separated from a sheet pile by feeder nozzles and fed by these feeder nozzles to a sheet-processing machine. The feeder nozzles are disposed so as to be controllable incrementally via a pivotally disposed crank transmission. The feeder nozzles are tipped or tilted by the pivoting motion and are therefore set on edge or caused to assume a canted position on the sheets. Moreover, tipping or tilting of the feeder nozzles at the end of the transport path can result in the formation of folds and creases in the sheet.

SUMMARY OF THE INVENTION

It is accordingly an object of the invention to provide a sheet transport device of the foregoing general type which executes linearly directed motion.

With the foregoing and other objects in view, there is provided, in accordance with the invention, a device for transporting to a printing press, sheets singly separated from a sheet pile, comprising an electromagnetic linear drive mechanism.

In accordance with another feature of the invention, the electromagnetic linear drive mechanism includes a guide and a carriage movably supported in the guide.

In accordance with a further feature of the invention, the transporting device includes a strip disposed in the guide, the strip having a linear scale.

In accordance with an added feature of the invention, the guide is formed with a U-shaped profile, and permanent magnets are included for generating a magnetic field disposed in the legs of the U-shaped profile.

In accordance with an additional feature of the invention, the carriage carries a coil supplied with a control current.

In accordance with yet another feature of the invention, the transporting device includes a conveying-holding device carried by the carriage.

In accordance with yet a further feature of the invention, the conveying-holding device is a combined lifting and dragging suction unit.

In accordance with yet an added feature of the invention, the transporting device includes a control computer connected to the coil via a motor control and a drive output element.

In accordance with yet an additional feature of the invention, the control computer has a memory wherein there is stored an algorithm corresponding to a closed-loop control circuit linking together a plurality of parameters feedable to the control computer.

In accordance with still another feature of the invention, the parameters are the speed of the printing press and the actual position of the carriage.

In accordance with still a further feature of the invention, the carriage has a forward and a reverse movement, and a mechanical stop is included for reinforcing the reverse movement of the carriage.

In accordance with still an added feature of the invention, the stop is a spring-damper system.

In accordance with another aspect of the invention, there is provided a combination of the transporting device and the printing press, the printing press being a sheet-fed printing press wherein the electromagnetic linear drive mechanism is installed, the sheet-fed printing press having a conveyor belt feeding table disposed between a feeder pile and a printing unit of the printing press.

In accordance with a further feature of the invention, the conveyor belt feeding table is a suction-belt feeding table.

In accordance with an added aspect of the invention, there is provided a combination of the transporting device and the printing press, the printing press being a sheet-fed printing press wherein the electromagnetic linear drive mechanism is installed, the sheet-fed printing press having grippers to which sheets separated from the sheet pile are directly transferable.

In accordance with an additional feature of the invention, the electromagnetic linear drive mechanism is pivotable in a horizontal plane.

In accordance with yet another feature of the invention, the transporting device includes leading-edge stops fixedly disposed at the sheet pile.

In accordance with a concomitant aspect of the invention, there is provided a method for transporting a sheet singly separated from a sheet pile, which comprises initially feeding the sheet counter to a sheet transport direction to a printing press.

An advantage of the invention is, in particular, that when an electromagnetic linear drive mechanism is used, the transfer speed of the sheets can be selected freely. The transfer speed is the speed of the sheet, i.e., in the ideal case, the speed of the leading edge of the sheet=the speed of the drag suction device in the transport direction, at the instant of transfer from the drag suction devices to the conveyor belts of the feeding table. In feeding tables which assure sheet transport with the aid of indexing rollers, the instant of transfer and, thus, the speed are defined by the frictional connection of the indexing roller, the sheet and the conveyor belt. This includes the possibility that a freely selectable speed of the transport devices can be achieved. By this provision, the parameters which affect the transport, such as the paper thickness, format, transfer speed, and so forth, can be taken into account so precisely that optimal paper travel can be established.

Connections by transmissions or gearing with following sheet-processing machines can be omitted. The device according to the invention is also distinguished by low wear and high repetition accuracy. Moreover, high transport speeds are realizable.

Through the use of modified startup strategies, it is possible, for example, to replace the folding or hinged shaft with a fixed leading-edge stop. This stop need not be folded out of the way in the machine cycle of the printing press. This is achieved by the fact that the linear drive mechanism accelerates the speed of the sheet initially, counter to the transport direction, and thus moves the leading edge thereof away from the leading-edge stops. By blowing air under the sheet, the latter is then lifted above the leading-edge stop and then speeded up in the production direction by the drag suction devices.

To improve the speed profile in the sense of shortening running or processing times, a mechanical stop can be employed. The braking distance and the rearward acceleration of the linear drive mechanism are shortened with the aid of a spring-damper system, after the sheet to be transported has been transferred to the conveyor belts. Accordingly, at predetermined total cycle times for the actual operating cycle (applying suction to the paper, accelerating it in the transport direction, and transferring it to the subsequent units), more time is available, and it can be utilized to increase the transport performance.

Other features which are considered as characteristic for the invention are set forth in the appended claims.

Although the invention is illustrated and described herein as embodied in a device for transporting sheets singly separated from a sheet pile, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
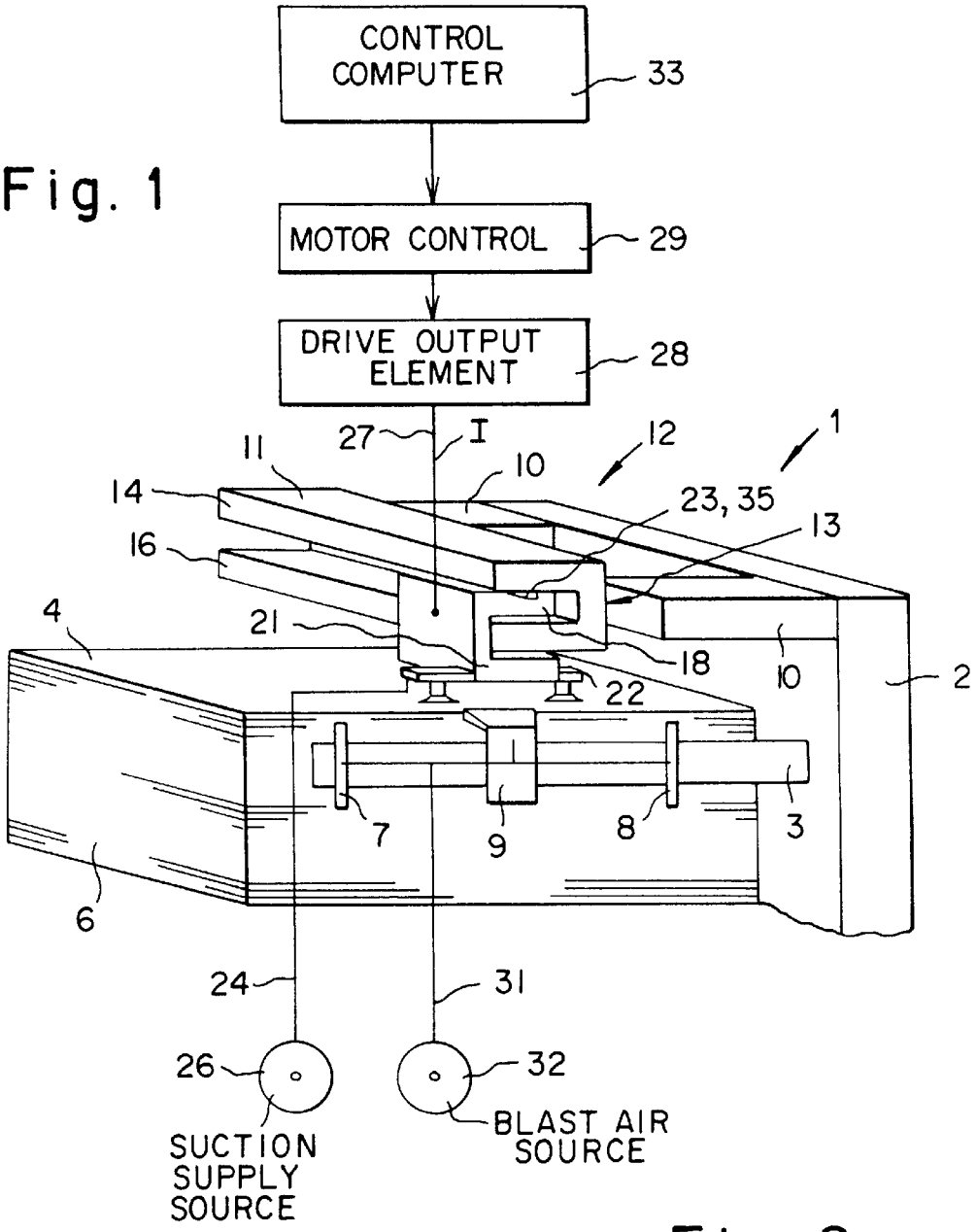
FIG. 1 is a schematic and diagrammatic rear, top and side perspective view of the device according to the invention.

Referring now to the drawing and, first, particularly to FIG. 1 thereof, there is shown therein a sheet feeder 1 for a sheet-processing machine, such as a printing press, in particular, having a frame 2, whereon a first crossbar or traverse 3 is secured for the purpose of holding auxiliary elements thereon for assisting in the separation of a sheet 4 from a sheet pile 6. These auxiliary elements are, for example, loosening blowers 7 and 8 and a feeler or sensing foot 9 for ascertaining the exact height of the sheet pile and for controlling the tracking thereof.

Figure 2:
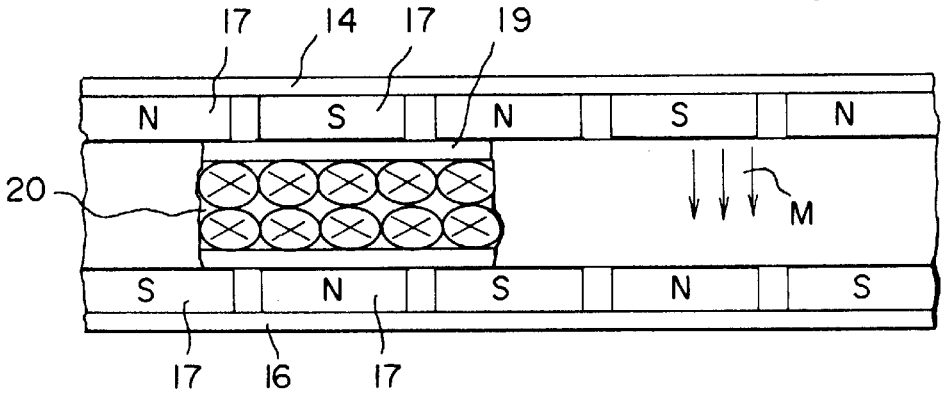
FIG. 2 is an enlarged fragmentary side elevational view of FIG. 1, showing diagrammatically an electromagnetic linear drive forming part of the invention.
Figure 3:
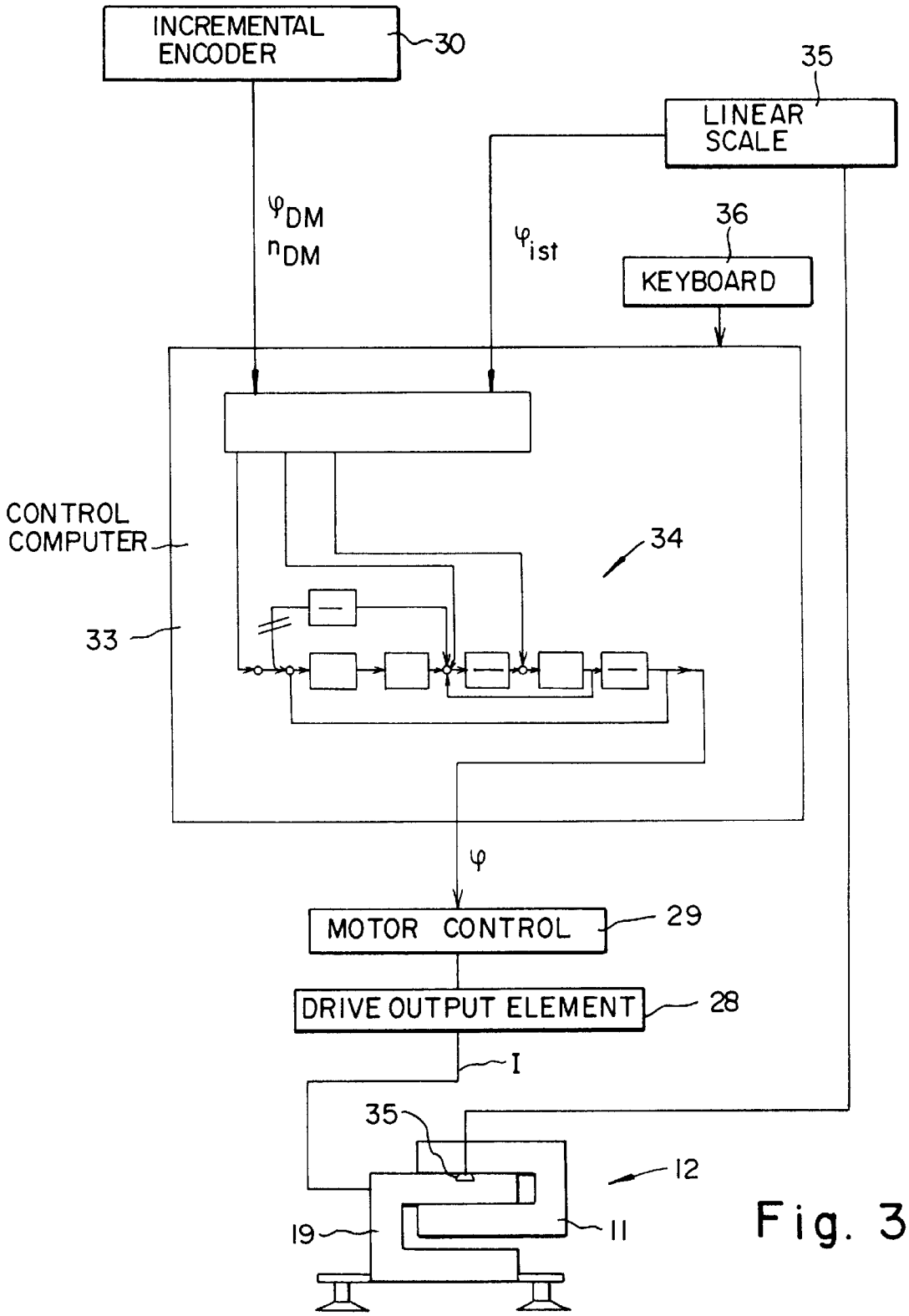
FIG. 3 is a block diagram of the control for the linear drive.

Secured above the stack 6 and parallel thereto is a second crossbar or traverse 10 disposed on the frame 2 and extending approximately to the middle of the sheet pile 6. At the free end of the crossbar 10, an electromagnetic linear drive 12 is carried. The electromagnetic linear drive 12 extends from one end of the sheet pile 6, in a direction towards the printing press, i.e., into the plane of FIG. 1, over a distance which is at least equal to the format length of the sheets to be processed. The linear drive 12 is made up essentially of a rail-like guide 11 and a carriage 19 (note FIG. 2) which is displaceable in the guide 11. The guide 11 is a horizontally disposed U-shaped profile member, which is secured by a bottom face 13 thereof to the crossbar 10 and, as shown in FIG. 2, is provided with permanent magnets 17 in the legs 14 and 16 thereof, the magnets 17 being mounted in a row, with alternating poles, in the sheet transport direction. As shown in FIG. 2, a north pole N of a permanent magnet 17 in the leg 14 is spaced from an opposite south pole S in the leg 16, and the reverse, while within either leg 14 or 16 itself, side-by-side north and south poles alternate N-S-N-S and so forth. A magnetic field M is generated between the legs 14 and 16 by the permanent magnets 17. Between the legs 14 and 16 in the magnetic field M, the carriage 19 is shown provided with a coil 20 which is secured to a first leg 18 of a second, likewise horizontal U-shaped profile. A second leg 21 of this second U-shaped profile carries a combined lifting and dragging suction unit 22. The first leg 18 of the second U-shaped profile is supported between the legs 14 and 16 of the first U-shaped profile so as to be displaceable in and counter to the sheet transport direction and is secured against falling out at the side by a dovetail guide 23. Via a control line 27, the coil 20 is controlled by a drive output element 28, which is connected to a motor control 29. The lifting and dragging suction unit 22 is connected to a suction supply source 26 by a supply line 24. The loosening blowers 7 and 8 and a non-illustrated blower on the feeler foot 9 communicate via a supply line 31 with a blast or blown air source 32.

The motor control 29 receives control commands from a control computer 33. Amongst other things, the blast air and the supply of suction for the sheet feeder 1 are controlled by the control computer 33. From a number of parameters and from a characteristic curve or algorithm stored in memory in the form of a closed-loop control circuit 34, the control computer 33, amongst other tasks, determines the control current I for the electromagnetic linear drive mechanism 12. The parameters required to calculate the control current I are the printing press speed $n_{DM}$ and the machine angle $\phi_{DM}$ for the printing press from the incremental encoder 30, and the actual position value $\phi_{ist}$ of the carriage 19. The actual position value $\phi_{ist}$ is read from a linear scale 35, which is disposed on the dovetail guide 23. The desired or nominal-value parameters, such as the desired position value $\phi_{soll}$, the desired speed value $n_{soll}$ a and the desired acceleration value $a_{soll}$ for the carriage 19 and the coil 20, respectively, are furnished by the characteristic curve 37.

An idle stroke of the carriage 19 with the coil 20, i.e., no sheet 4 is transported in the rearward motion of the feeder elements 22 counter to the sheet transport direction, can be executed faster than the transport of the sheet 4. To support or assist in the turnaround motion of the feeder elements 22 after the sheet transfer to a provided conveyor, a stop 41 is provided which is disposed by a damper-spring system on the feeder frame 2, in particular, in the guide of the linear drive mechanism 12.

The device according to the invention can be employed in various general types of sheet feeder systems.

Figure 4:
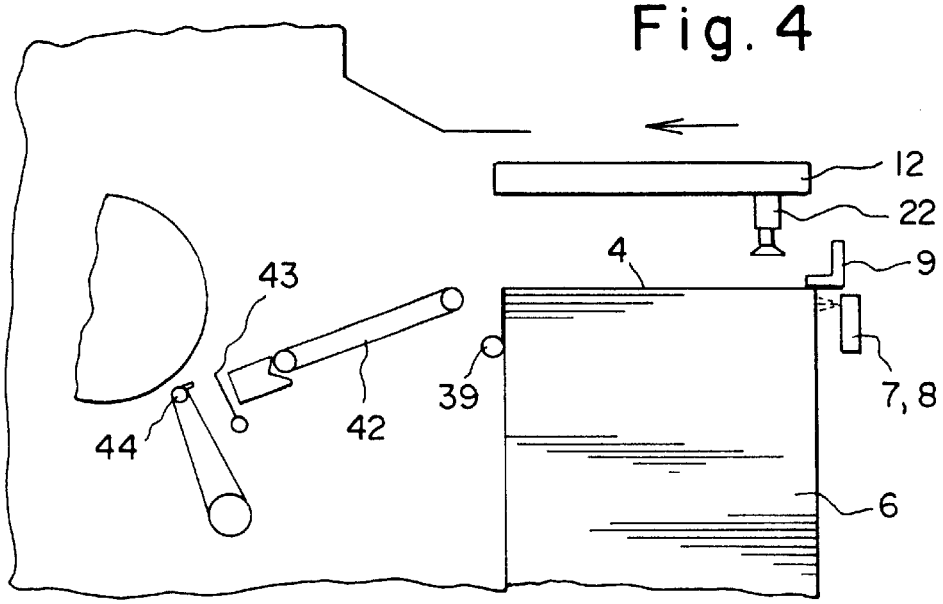
FIG. 4 is a fragmentary diagrammatic side elevational view of FIG. 1, showing a sheet feeder with a feeding table.

FIG. 4 illustrates the application of the electromagnetic linear drive mechanism 12 in a separating or singling device which delivers the sheets 4 to a suction belt table 42. For this purpose, the respective sheet 4, in the region of the trailing edge thereof, is gripped by suction and lifted by a combined lifting and dragging sucker or suction device 22 and transported in synchronism with the operating cycle of the printing press, and in accordance with the transport speed of the suction belt table 42, respectively, to front lays 43 which have been provided. At the front lays 43, the sheet 4 is aligned and then transferred by suitably provided pregrippers 44 to the cylinders of the printing press. The takeover point, namely, the position of the lifting suction device upon separation of the sheet 4 from the sheet pile 6, can be input into the control computer 33 by a keyboard 36, as a function of or in accordance with the format length of the sheet to be processed.

Figure 5:
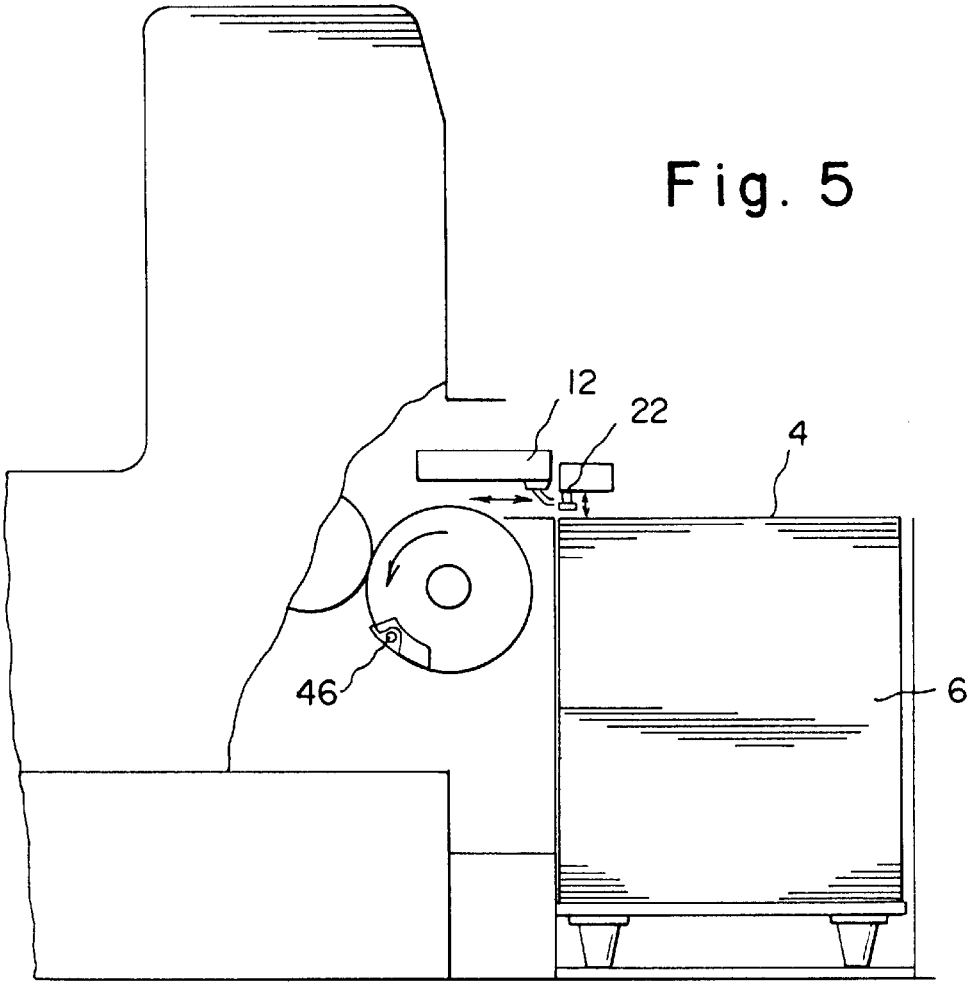
FIG. 5 is a diagrammatic side elevational view of another embodiment of the sheet feeder followed by a printing press without any feeding table.

FIG. 5 illustrates the application of the electromagnetic linear drive mechanism 12 in a sheet feeder 1 wherein the sheets 4 are separated by a lifting suction device from the sheet pile 6 and are transferred in the raised position thereof to the feeder elements of the linear drive mechanism 12, which then transfers them directly to a gripper 46 of the printing press. In this regard, the feeder elements of the linear drive mechanism 12 are constructed as drag suction devices or grippers.

Of course, it is also conceivable that the linear drive mechanism 12 be equipped, in accordance with FIG. 4, with drag suction devices, which take over the separated sheets in the raised state, for example, from a lifting suction device system.

It is naturally also conceivable for the linear drive mechanism to be equipped, in accordance with FIG. 5, with a combined lifting and drag sucker or suction device, so that an additional lifting unit for separating the sheet from the sheet pile can be dispensed with.

Figure 6:
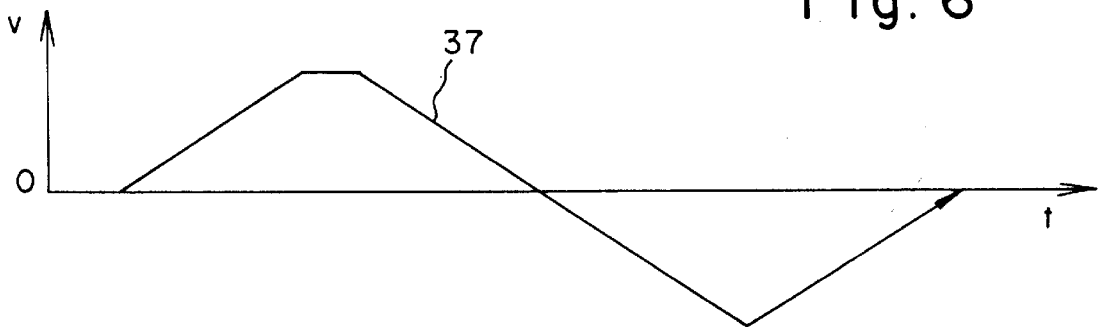
FIG. 6 is a plot diagram showing a characteristic curve for the speed of the electromagnetic linear drive mechanism.
Figure 7:
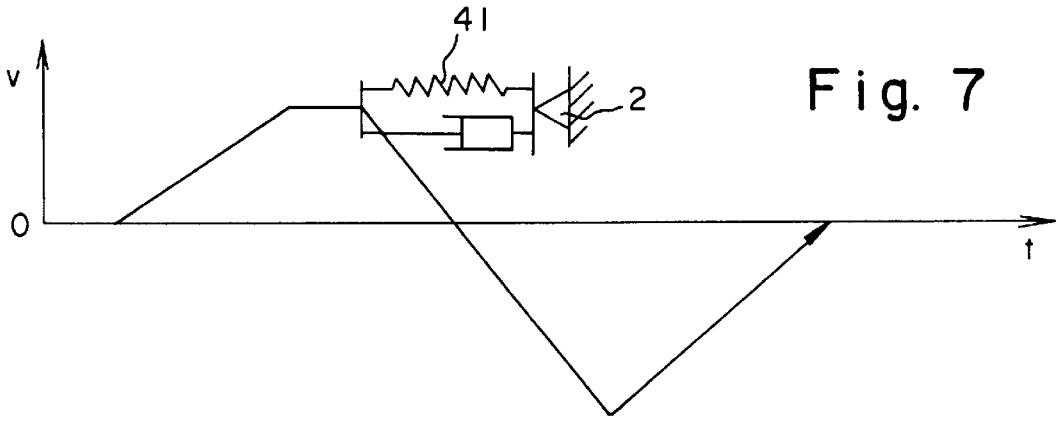
FIG. 7 is a plot diagram showing a characteristic curve for the speed of the electromagnetic linear drive provided with a spring damper stop element.
Figure 8:
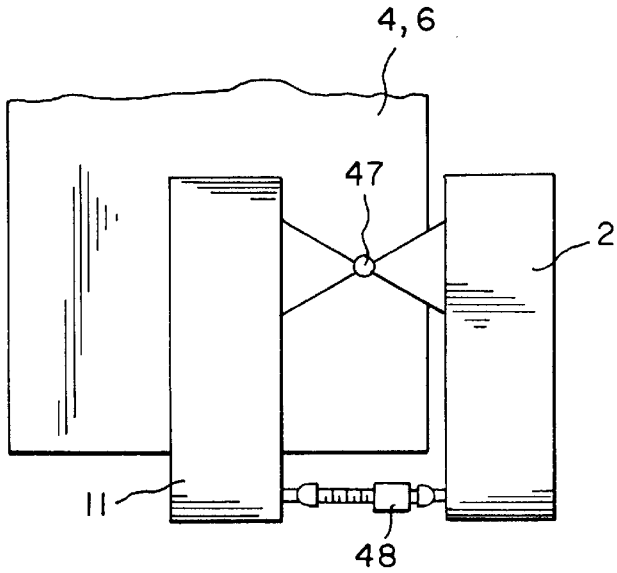
FIG. 8 is a fragmentary diagrammatic top plan view of FIG. 1 showing another embodiment of the invention which includes a device for pivoting the electromagnetic linear drive.

In all of the exemplary embodiments described hereinbefore, the electromagnetic linear drive mechanism 12 functions as follows:

In accordance with a characteristic speed curve 37 shown in FIG. 6, the carriage 19 is stopped in a receiving position, as a function of or in accordance with the format length of the sheet 4 to be processed. The top sheet 4 on the sheet pile 6 is separated from the sheet pile 6 and raised by a separating element 22 (such as a jump-type suction device, for example).

Then, the carriage 19 with the feeder elements 22 disposed thereon is then accelerated to transfer speed. The transfer speed is kept constant over a transfer region until the transfer of the sheets 4 (for example, to a conveyor belt 42) has occurred. Directly after sheet transfer has been accomplished, the carriage 19 is braked, stopped, and caused to execute a reverse motion by a reversal of the control of the motor current I. During the execution of the reverse motion, the carriage 19 is accelerated to a predetermined reverse speed and, upon attaining the maximum reverse speed, is braked down to a speed of zero. The carriage 19 is then at a standstill, and the feeder elements 22 are ready to receive the next sheet 4.

In the illustrated exemplary embodiments, a slide enhancer is provided between the carriage 19 and the guide 11, the sliding properties being improved thereby, for example, by coating the sliding surfaces with Teflon (tetrafluoroethylene) or "nano-ceramic".

To improve the sliding properties between the carriage 19 and the guide 11, it is also conceivable to provide pneumatic guidance by creating an air cushion or by providing roller guidance or magnetic levitation guidance.

Pre-alignment of the sheet 4 to be transported can be accomplished, for example, by supporting the crossbar 11 on the frame 2 by an articulated connection 47 and, by employing an adjusting element 48 for pivoting the crossbar 11 horizontally. With these features, the respective sheet 4 which is separated from the sheet pile 6 can be pivoted over the transport path thereof. The control computer 33 also furnishes control signals for the magnitude of the pivoting motion and, for this purpose, is connected to non-illustrated suitable conventional sensor means for detecting respective sheets which are disposed in oblique positions.

By employing the electromagnetic linear drive mechanism 12 in the exemplary embodiment of FIG. 4, provision can be made for the stop flaps 39 for the leading or front edge of the sheet pile 6, which are movably supported in the prior art, to be constructed so as to be fixed or stationary. A method for transporting the sheet 4 consequently includes initially moving the sheet 4, which has been separated from the sheet pile 2 by the lifting device 22, counter to the provided transport direction to the printing press. Due to the foregoing features, whichever sheet 4 is on top of the sheet pile 6 can be released from the leading-edge stops, i.e., the stop flaps 39.

We claim:

1. A transporting device for transporting sheets from a sheet pile to a printing device, comprising:

a transporting device for transporting sheets to a printing device having an electromagnetic linear drive mechanism.

2. The transporting device according to claim 1, wherein said electromagnetic linear drive mechanism includes a guide and a carriage movably supported in said guide.

3. The transporting device according to claim 2, including a strip disposed in said guide, said strip having a linear scale.

4. The transporting device according to claim 2, wherein said guide is formed with a U-shaped profile, and including permanent magnets for generating a magnetic field disposed in the legs of said U-shaped profile.

5. The transporting device according to claim 2, wherein said carriage carries a coil which is to be supplied with a control current.

6. The transporting device according to claim 5, including a conveying-holding device carried by said carriage for transporting paper.

7. The transporting device according to claim 6, wherein said conveying-holding device is a combined lifting and dragging suction unit.

8. The transporting device according to claim 5, including a control computer connected to said coil via a motor control and a drive output element for controlling a coil current of said coil.

9. The transporting device according to claim 8, wherein said control computer has a memory wherein there is stored a characteristic curve corresponding to a closed-loop control circuit linking together a plurality of parameters feedable to said control computer.

10. The transporting device according to claim 9, wherein said parameters are the speed of the printing press and the actual position of the carriage.

11. The transporting device according to claim 2, wherein said carriage has a forward and a reverse movement, and including a mechanical stop for reinforcing said reverse movement of said carriage.

12. The transporting device according to claim 11, wherein said stop is a spring-damper system.

13. In combination, the transporting device according to claim 1 and the printing press, the printing press being a sheet-fed printing press wherein said electromagnetic linear drive mechanism is installed, said sheet-fed printing press having a conveyor belt feeding table disposed between a feeder pile and a printing unit of the printing press.

14. The combination according to claim 13, wherein said conveyor belt feeding table is a suction-belt feeding table.

15. In combination, the transporting device according to claim 1 and the printing press, the printing press being a sheet-fed printing press wherein said electromagnetic linear drive mechanism is installed, said sheet-fed printing press having grippers to which sheets separated from the sheet pile are directly transferable.

16. The transporting device according to claim 1, wherein said electromagnetic linear drive mechanism is pivotable in a horizontal plane.

17. The transporting device according to claim 1, including leading-edge stops fixedly disposed at the sheet pile.

18. The transporting device according to claim 1 wherein a sheet is initially moved counter to the sheet transport direction.

19. An electromagnetic linear drive mechanism for a transporting device for transporting singly separated sheets from a sheet pile to a printing device, comprising:

an electromagnetic linear drive mechanism;

said electromagnetic linear drive mechanism includes a guide and a carriage movably supported in said guide;

said carriage carries a coil supplied with a control current and a conveying-holding device, said conveying-holding device is a combined lifting and dragging suction unit.

* * * * *